US006827185B2

(12) United States Patent
Scicluna

(10) Patent No.: US 6,827,185 B2
(45) Date of Patent: Dec. 7, 2004

(54) PROTECTIVE SUSPENSION SYSTEM FOR PORTABLE COMPUTER

(75) Inventor: Paul V. Scicluna, Penndel, PA (US)

(73) Assignee: TUMI, Inc., South Plainfield, NJ (US)

( * ) Notice: Subject to any disclaimer, the term of this patent is extended or adjusted under 35 U.S.C. 154(b) by 38 days.

(21) Appl. No.: 10/318,311

(22) Filed: Dec. 12, 2002

(65) Prior Publication Data

US 2004/0112697 A1 Jun. 17, 2004

(51) Int. Cl.[7] ..... A45C 3/00; A45C 5/12

(52) U.S. Cl. ..... 190/110; 190/109; 150/113; 206/320

(58) Field of Search ..... 190/108–112, 102; 150/112, 113; 206/316.2, 320, 523, 583

(56) References Cited

U.S. PATENT DOCUMENTS

| | | | | | |
|---|---|---|---|---|---|
| 4,210,186 | A | * | 7/1980 | Belenson | 206/316.2 |
| 4,403,638 | A | * | 9/1983 | Baum | 206/316.2 |
| 4,545,414 | A | * | 10/1985 | Baum | 224/580 |
| 4,610,286 | A | * | 9/1986 | Cyr | 206/316.2 |
| 5,217,119 | A | | 6/1993 | Hollingsworth | 206/583 |
| 5,494,157 | A | * | 2/1996 | Golenz et al. | 206/320 |
| 5,524,754 | A | | 6/1996 | Hollingsworth | 206/320 |
| 5,529,184 | A | * | 6/1996 | Sadow | 206/320 |
| 5,678,666 | A | * | 10/1997 | Shyr et al. | 190/102 |
| 5,725,090 | A | * | 3/1998 | Vermillion et al. | 206/320 |
| 5,775,497 | A | * | 7/1998 | Krulik | 206/320 |
| 5,808,865 | A | * | 9/1998 | Alves | 361/685 |
| 6,105,764 | A | * | 8/2000 | Scicluna et al. | 206/320 |
| 6,131,734 | A | | 10/2000 | Hollingsworth | 206/320 |
| 6,334,533 | B1 | * | 1/2002 | Hollingsworth et al. | 206/320 |
| 2002/0027052 | A1 | * | 3/2002 | Godshaw et al. | |

FOREIGN PATENT DOCUMENTS

| | | | | |
|---|---|---|---|---|
| JP | 2003034324 | A * | 2/2003 | B65D/5/42 |

* cited by examiner

*Primary Examiner*—Sue A. Weaver
(74) *Attorney, Agent, or Firm*—Baker Botts LLP

(57) ABSTRACT

A bag, of tote or briefcase size, includes a removable and adjustable protective cradle for carrying a portable computer or other sensitive device. The cradle may be selectively secured at different heights to divider members within the interior of the bag. When not needed, the protective cradle may be removed from the bag to free the bag to carry other contents.

6 Claims, 3 Drawing Sheets

PROTECTIVE SUSPENSION SYSTEM FOR PORTABLE COMPUTER

BACKGROUND OF INVENTION

1. Field of the Invention

The present invention relates to bags, such as luggage, business cases, carry-on bags, totes and the like, and more particularly to a bag having incorporated therein a protective suspension system for a portable computer or other sensitive objects.

2. The Related Art

With the rapid growth of portable computing, laptop computer ("laptop") purchases now represent a significant market share of the personal computing market. In many instances laptops offer the same functionality as their desktop computer equivalents for a slightly higher price tag. Thus, it has now become commonplace for employers to purchase laptops for their traveling professionals.

When embarking on a business trip, these traveling professionals are often faced with the problem of too many parcels to carry. For example, the standard array of bags for a traveling professional usually consists of a bag for clothing, a second bag to carry business related materials (papers, contracts, etc.), and a third bag to carry a laptop. The laptop is often carried in a separate bag from the traveling professionals' clothing and business materials because, for damage prevention, laptops require a protective system to absorb any shock in case the bag containing the laptop is dropped or otherwise impacted.

In addition, in light of today's heighten airport security measures, where persons are randomly selected for baggage searches, having less bags quantitatively is better for a traveler. What is needed, therefore, is a system for reducing the number of bags required for travel by the business traveler, while ensuring that protection for a laptop is not compromised.

SUMMARY OF THE INVENTION

It is an object of the present invention to fulfill the foregoing and other needs of the prior art by the provision of a bag, e.g., of the tote or hand-carried size, having an integral protective suspension system for a portable computer on other sensitive objects.

The protective suspension system is preferably provided in the main body compartment of the bag, advantageously as a removable, generally U-shaped insert that may be attached and detached from the bag, so as to provide a protective support for items such as laptops, when attached, and to provide space for other items, when not attached. When attached to an interior compartment of the bag, the protective support may suspend a laptop or other sensitive electronic device above the bottom of the bag and provide for shock absorption, in the event the bag is dropped, by means of a padded bottom to the protective support.

In one embodiment, the protective suspension system includes a cradle made of non-elastic mesh panels joined by a foam pad. In addition, non-elastic strips are fixed across the non-elastic mesh panels and the foam pad. The combined effect of the non-elastic mesh panels and the non-elastic strips is to prevent the panels from stretching in the lengthwise direction during use.

The cradle is removable and adjustably attachable between two divider members of the bag to form a U-shaped suspension system. For that purpose, the divider members are covered on both sides with the loop half of a hook and loop fastener material, to which strips of hook material on the upper ends of the panels of the protective system are affixed. The divider members are reinforced internally, so as to be able to bear the weight of a laptop or other portable electronic device supported thereon via the non-elastic cradle. In this way, a protective suspension system for a laptop or other delicate electronic device is provided, while eliminating the need for a separate bag to carry a laptop or other electronic device.

BRIEF DESCRIPTION OF THE DRAWINGS

For a more complete understanding of the present invention and the advantages thereof, reference may be made to the following description of exemplary embodiments thereof, taken in conjunction with the accompanying drawings, in which.

DESCRIPTION OF AN EXEMPLARY EMBODIMENT

Figure 1:
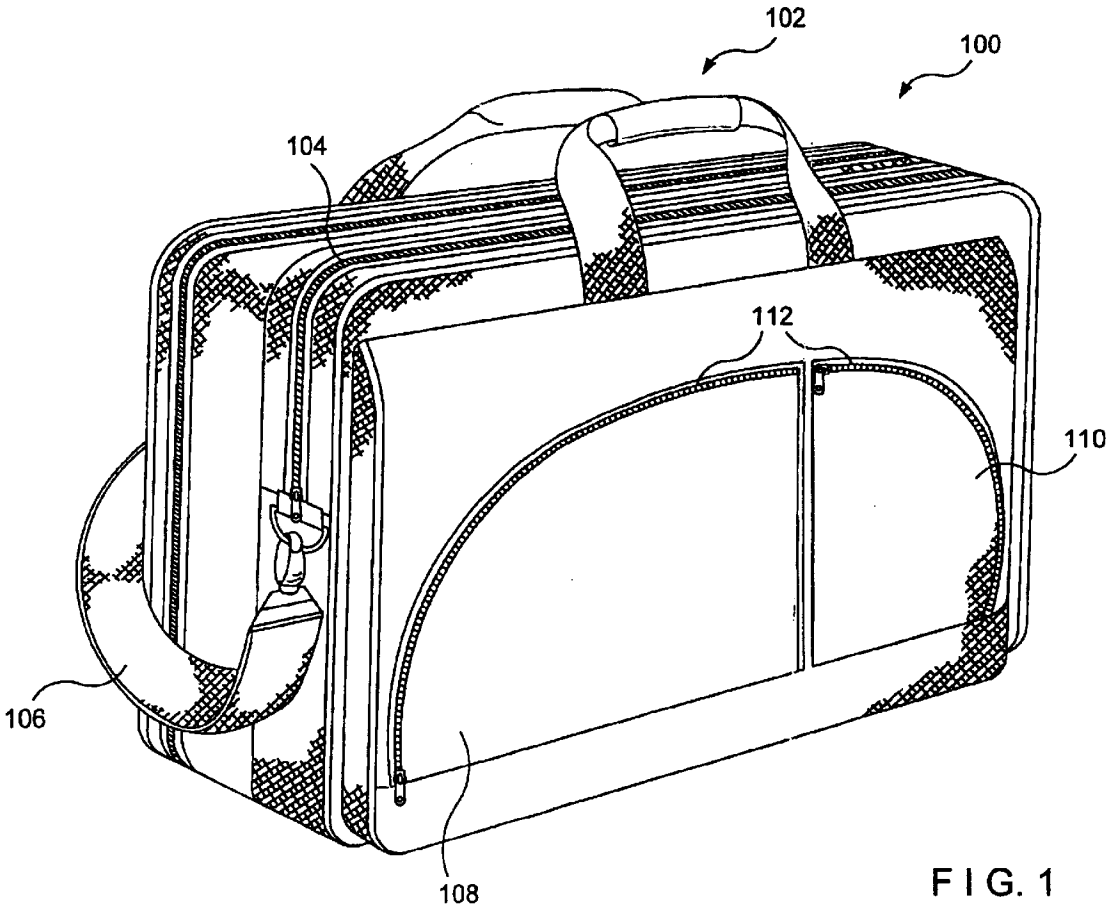
FIG. 1 is a generally schematic perspective view of a bag having an integral protective support system for use in carrying a laptop or other electronic device in accordance with the present invention.

FIG. 1 depicts a bag or luggage item 100, of tote or briefcase size, which is adapted to be carried by an individual by means of the handles 102 or shoulder strap 106. Such a bag would typically include one or more zippered main pockets 104 for papers, overnight articles, and the like, and one or more side or exterior pockets 108, 110 for storage of readily accessible items. In the usual case, the bag 100 would be carried with a person when traveling on business or vacation, or simply traveling to the office. Preferably, the exterior pockets 108, 110 are fastened or opened by closure mechanisms, e.g., zippers 112, extending along the tops and down the sides of the pockets. The exterior of the bag 100 may be made of any suitable material, such as the fabric customarily used to cover "soft" briefcases or the like, e.g., ballistic nylon fabric.

Figure 2:
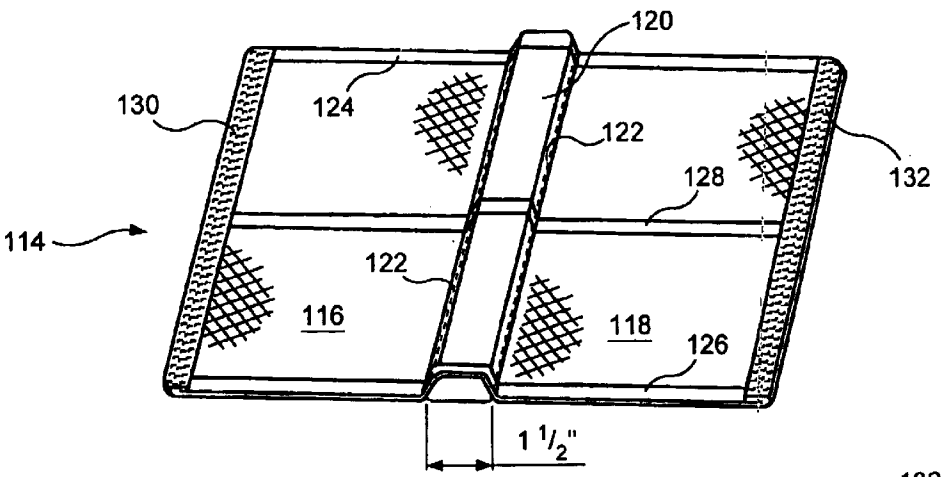
FIG. 2 is a detailed illustration of an embodiment, in accordance with the present invention, of an unfolded protective cradle outside of the bag of FIG. 1.
Figure 3:
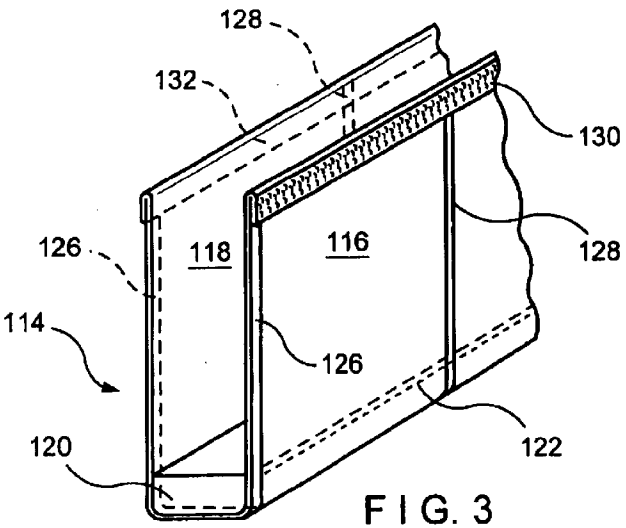
FIG. 3 illustrates the protective cradle of FIG. 2 in the U-shaped configuration it takes when inserted into the bag of FIG. 1.

In accordance with the invention, a protective cradle is removably integrated into the bag 100. As shown in FIGS. 2 and 3, the protective cradle 114 is comprised of two non-elastic panels 116, 118 joined together by an elongated foam pad 120. Preferably, the panels 116, 118 are rectangular in shape and are made of a non-elastic mesh material, such as polyester or nylon yarn. The foam pad 120 is preferably on the order of 1½" wide and ¾" thick and is located centrally of the length and extending across the width of the cradle 114.

The panels 116, 118 are shown in FIGS. 2 and 3 as separate fabric members that are sewn or otherwise attached, as indicated at 122, to the foam pad 120. If desired, the panels 116, 118 could be formed from a single fabric member which extends over the bottom of the foam pad 120.

Non-elastic strips 124, 126 are affixed to the respective ends of the cradle 114, extending across the panel 116, the foam pad 120 and the other panel 118. Preferably, a third non-elastic strip 128 extends centrally of the panels 116, 118 and the foam pad 120. The combined effect of the non-elastic panels 116, 118 and the non-elastic strips 124, 126, 128 prevents the panels 116, 118 from stretching in the lengthwise direction, i.e., downward, during use. The protective cradle 114 also includes a strip 130, 132 of the hook half of a hook-and-fastener material, e.g., Velcro™, along the upper edge of each panel 116, 118.

Figure 4:
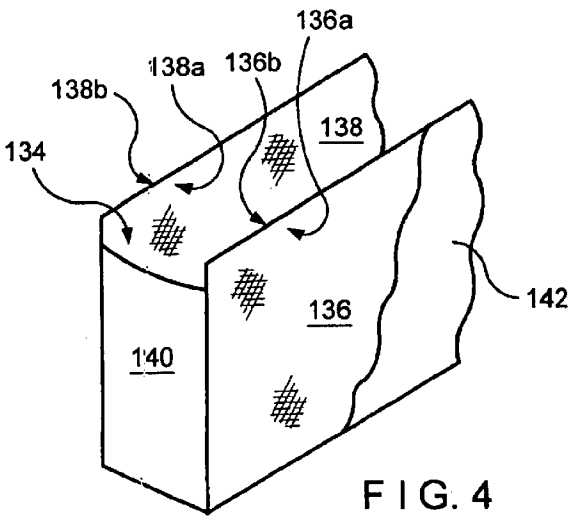
FIG. 4 is a detailed illustration of the interior compartment of the bag of FIG. 1 without the protective cradle of FIG. 2 in accordance with the present invention.

FIG. 4 illustrates an interior cavity or compartment 134 of the bag 100. The compartment 134 is formed by two divider members 136, 138 that are interconnected at their ends by flexible wall members 140 and that are permanently fastened within the bag 100. In accordance with the invention, the divider members 136, 138 are covered on both sides 136*a*, 136*b*, 138*a*, 138*b* (see directional arrows) with the loop half of a hook-and-loop fastener material, e.g., Velmat™. The divider members 136, 138 are reinforced internally by stiffening panel-like members 142, e.g., pressboard, so as to be able to bear the weight of a laptop, or other electronic device, supported thereon via the protective cradle 114.

Conversely, in accordance with an alternative embodiment, the divider members 136, 138 may include the hook-fastener material and the protective cradle 114 may include the loop-fastener strips instead of the hook strips 130, 132.

Figure 5:
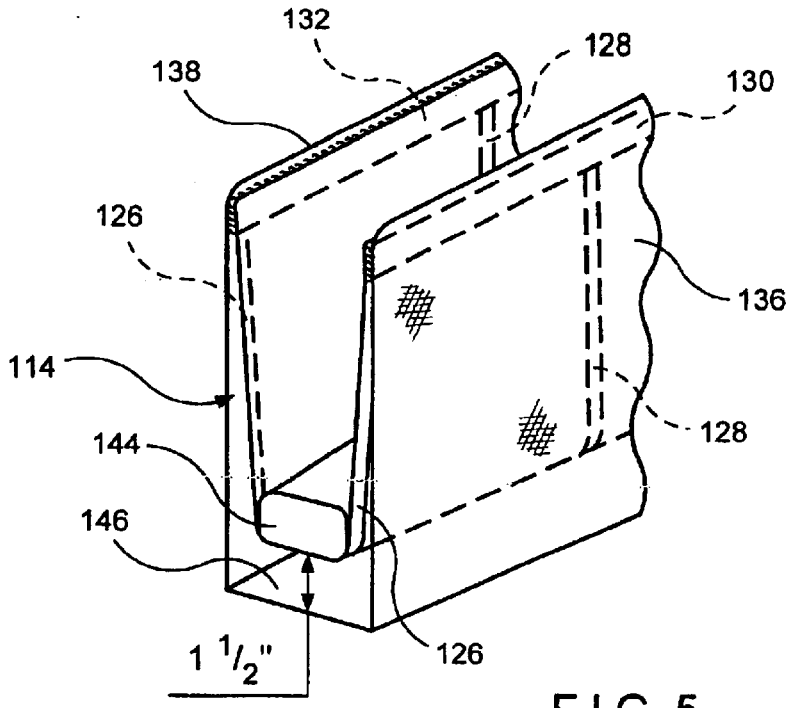
FIG. 5 is a detailed illustration of the interior compartment of the bag of FIG. 1 with the protective cradle of FIG. 2 in place in accordance with the present invention.

When installed into the compartment 134, as shown in FIG. 5, the hook strips 130, 132 of the protectable cradle 114 are affixed to the divider members 136, 138 via the interlocking hook-and-loop fastener materials. So installed, the cradle 114 takes a generally U-shaped configuration for suspending a computer or other device. The panels 116, 118 comprise the legs of the U-shaped cradle, with the pad 120 at the lower, closed end and the hook strips 130, 132 at the upper, free ends of the legs.

As a feature of the invention, the height of attachment of the cradle 114 within the bag 100 can be varied in accordance with the size of the device to be suspended therein. As shown in FIG. 5, for example, the hook fastener strips 130, 132 are affixed to the loop-fastener material on the divider members 136, 138 at or near the upper edges thereof, leaving a gap of, for example, approximately 1½ inches between the bottom 144 of the cradle and the bottom 146 of the bag. This arrangement is suitable for supporting a laptop, for example.

For larger devices, the strips 130, 132 could be affixed to the dividers 136, 139 at lower positions therealong. Although this would reduce the gap between the bottom 144 of the cradle and the bottom 146 of the bag, cushioning of the device against shock would still be provided by the reduced gap and, even if no gap existed, by the pad 120.

Figure 6:
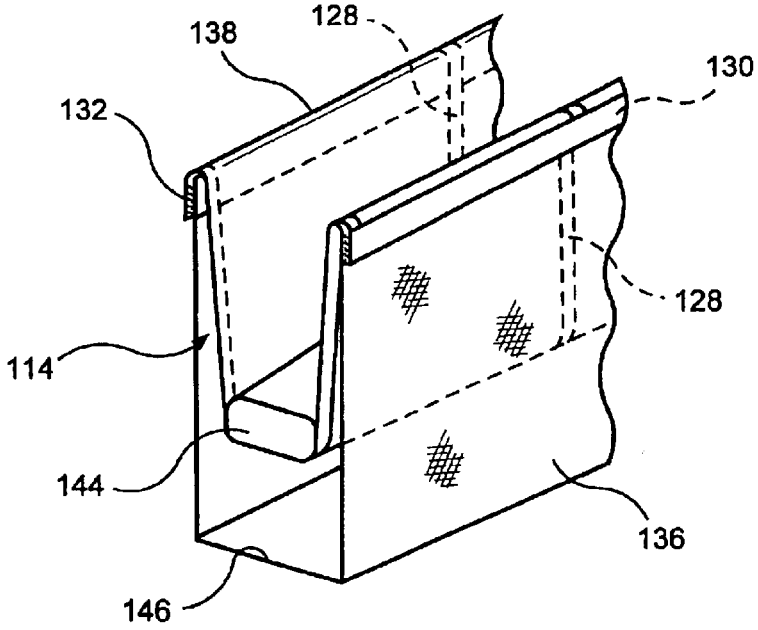
FIG. 6 is an illustration of an alternate position of the protective cradle in place in the interior compartment of the bag.

For smaller devices, the panels 116, 118 of the cradle 114 could be folded over the upper edges of the divider members 116, 118 and the strips 130, 132 affixed to the outer surfaces of the divider members, as shown in FIG. 6. This raises the lower end 144 of the cradle 114 and suspends the device at a readily accessible height within the bag 100.

As a further feature of the invention, the protective cradle 114 may be removed entirely from the bag 100 by detaching the hook strips 130, 132 from the loop-fastener material on the divider members 136, 138. The space between the divider members 136, 136 can then be used to carry or store other items. A significant advantage of this removability feature is that the bag 100 need not be a dedicated computer carry bag, but may also serve other purposes.

Thus, the protective cradle 114 of the present invention provides a move efficient system for carrying a laptop with other items in one bag 100, as well as more storage space in the event the protective cradle 114 is not needed.

Although the invention has been described herein by reference to exemplary embodiments thereof, it will be understood that such embodiments are susceptible of modification and variation without departing from the inventive concepts disclosed. All such modifications and variations, therefore, are intended to be encompassed within the spirit and scope of the appended claims.

What is claimed is:

1. In a bag having a body and at least one interior compartment therein, the improvement comprising:

a pair of divider members forming permanent side walls in the compartment to subdivide the compartment;

one half of a hook-and-loop fastener material on both sides of each divider member;

a non-elastic U-shaped protective cradle for supporting a device within the compartment, the cradle being adapted to be received between the divider members with the legs of the U-shaped cradle being attached at the free ends thereof to respective ones of the divider members such that the closed end of the U-shaped cradle is suspended between the divider members;

a strip of the other half of the hook-and-loop fastener material attached to the outer surface of each leg of the U-shaped cradle adjacent the free end thereof; and an elongated pad at the closed end of the U-shaped cradle to cushion a device supported by the cradle against shock.

2. The bag of claim 1, wherein the protective cradle comprises two panels, said panels forming the legs of the U-shaped cradle.

3. The bag of claim 2, wherein the two panels each are generally rectangular in shape.

4. The bag of claim 3, wherein the elongated pad comprises a foam pad.

5. The bag of claim 2, wherein the protective cradle further comprises a non-elastic strip attached to the side edge of each panel and extending over the panels and the pad to prevent the cradle from stretching in a lengthwise direction during use.

6. The bag of claim 5, wherein the protective cradle further comprises at least one additional non-elastic strip attached to the panels at a point between the side edges thereof and extending thereacross and across the pad in the lengthwise direction.

* * * * *